United States Patent [19]

Hellmich

[11] 4,084,527

[45] Apr. 18, 1978

[54] HOPPER BARGE BOTTOM SEAL CONSTRUCTION

[75] Inventor: Gerhard Hellmich, Deggendorf Germany

[73] Assignee: Deggendorfer Werft und Eisenbau G.m.b.H., Germany

[21] Appl. No.: 703,585

[22] Filed: Jul. 8, 1976

[30] Foreign Application Priority Data

Jul. 11, 1975 Germany ..... 2530929

[51] Int. Cl.[2] ..... B63B 35/30

[52] U.S. Cl. ..... 114/36

[58] Field of Search ..... 114/26–38, 114/77 R, 77 A, 201 A; 9/2 R, 2 S; 298/29–33

[56] References Cited

FOREIGN PATENT DOCUMENTS

| | | | |
|---|---|---|---|
| 42,170 | 2/1970 | Finland | 114/29 |
| 6,508,141 | 12/1965 | Netherlands | 114/201 A |
| 1,217,370 | 12/1970 | United Kingdom | 114/30 |

*Primary Examiner*—Trygve M. Blix
*Assistant Examiner*—Jesus D. Sotelo
*Attorney, Agent, or Firm*—McGlew and Tuttle

[57] ABSTRACT

A hopper barge bottom seal construction comprises a barge having a first and second pivotal part which extend longitudinally and are oriented with their lower ends extending obliquely together but spaced apart at their lower ends. A seal is provided below the lower ends of the parts for sealing the space therebetween and it comprises a first support which is positioned below the first pivotal part as a first top generally horizontal member engaged below the first part and secured to the bottom end thereof. A second support has a second top substantially horizontal member alongside the first top horizontal member and it is secured to the second pivotal part and both supports are movable inwardly toward each other and outwardly in an opposite direction during assembly. The first support has a lower support plate which extends below the second support and an elastic seal body in the form of a hollow tubular member is disposed between the bottom of the second support and the top of the lower support plate. A rib on each side of the seal body extending along the bottom of the second support holds the elastic seal body in place. The elastic seal body advantageously comprises a tube which is filled with a gaseous fluid which is pressurized to an extent which corresponds to the actual sealing pressure conditions.

2 Claims, 2 Drawing Figures

HOPPER BARGE BOTTOM SEAL CONSTRUCTION

FIELD AND BACKGROUND OF THE INVENTION

This invention relates in general to the construction of hopper barges and, in particular, to a new and useful bottom seal for such hopper barges.

DESCRIPTION OF THE PRIOR ART

In contrast to the known designs, the present invention provides a niche below the two pivotal barge parts which defines a seal and a support for the two pivotal parts and it covers the closure opening between the parts. In such an arrangement, the reliability of the sealing does not depend on the fact that the two sealing elements provided on the two parts of the barge contact each other along their entire length under a uniform pressure only in a quite definite closing position.

It is desirable not to use the tongue and the support themselves as sealing elements because, in such a case, in view of the width necessary for the discharge operation of the hopper barge, their service life would be endangered. This applies particularly to the tongue in the design of an elastic sealing element.

SUMMARY OF THE INVENTION

The present invention provides a sealing joint and the disadvantages of the prior art are avoided. An elastic seal body is provided between a support member of one support part and a support member or horizontally extending plate part of another support part and it is held in a position extending longitudinally by means of ribs on each side. The ribs are advantageously secured to the upper support part and they are advantageously oriented in a slightly oblique position relative to each other so that they converge downwardly toward the elastic part. The seal body itself advantageously comprises a flexible tube which, in the operative state, is filled with a gaseous fluid which is pressurized in accordance with the respective actual conditions.

Accordingly, it is an object of the invention to provide a hopper part bottom seal construction which comprises a barge having first and second pivotal parts extending longitudinally and extending obliquely downwardly toward each other at their lower ends and which is sealed between the lower ends by sealing means which comprises a first support having a first top horizontal member engaged below and secured to the bottom end of the first part, and a second support having a second top horizontal member alongside the first top horizontal member and being secured to the second part and, wherein, the first support has a lower support plate extending below the second support with an elastic seal body secured thereto between two longitudinally extending ribs and engaged over the top of the lower support plate.

A further object of the invention is to provide a hopper barge bottom seal construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENTS

Figure 1:
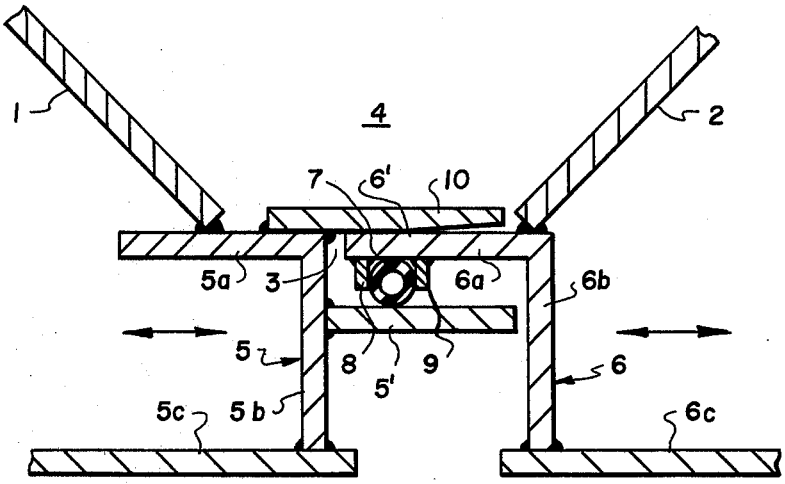
FIG. 1 is a partial sectional view of a bottom of a hopper barge constructed in accordance with the invention.
Figure 2:
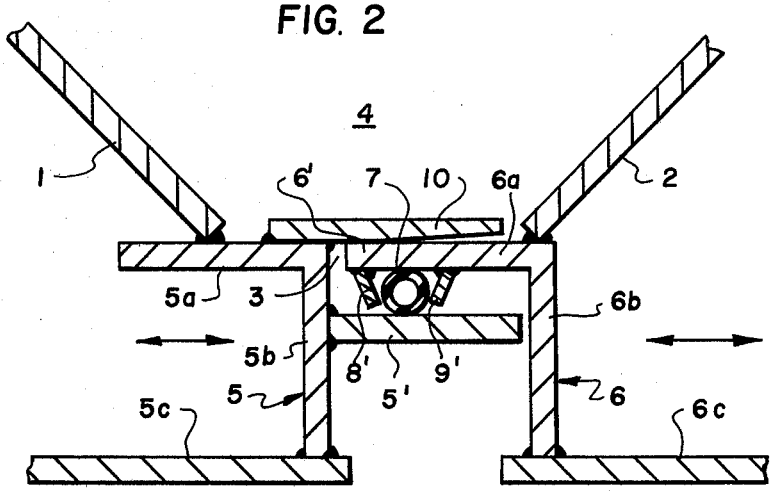
FIG. 2 is a view, similar to FIG. 1, of another embodiment of the invention.

Referring to the drawing in particular, the invention embodied therein in FIG. 1, comprises a hopper barge which comprises two barge parts 1 and 2 which are only partly shown and which are pivotal at their upper ends about longitudinal axes. The part of the barge which is indicated is around the bottom joint or opening 3 between the parts 1 and 2 which together form the loading space 4. The bottom joint is formed by two separate support members, generally designated 5 and 6, the first member 5 including a top substantially horizontal extending plate **5*a* which is secured to the lower end of the first hopper part 1 and which is supported by an upright part 5*b* on a baseplate 5*c*. In addition, the first support member includes a horizontally extending lower plate portion 5' which extends outwardly in an opposite direction. The second support member 6 comprises a vertical portion 6*b* which supports a substantially horizontal portion 6*a* which lies alongside the horizontal portion 5*a* and is secured to the lower end of the second hopper part 2. The second support 6 also includes a base part 6*c*. The horizontal part 6*a* of the second support overlies the lower plate 5' and, in accordance with the invention, an elastic sealing member 7 is disposed between these two parts. Sealing member 7 is held in a fixed longitudinally extending position by longitudinally extending ribs 8 and 9 which, in the embodiment of FIG. 1, are at substantially right angles and extend vertically downwardly from the second support horizontal plate 6*a*, and in the second embodiment shown in FIG. 2**, extend obliquely downwardly from this plate.

The elastic tubular member 7 is disposed between the bottom of the upper horizontal plate **6*a* which forms a tongue 6'** and it comprises a tubular member which is advantageously filled with air or another gas.

In a closed position of the hopper parts, the joint 3 is covered by a locking strip 10 which is welded to the upper plate **5*a* of the first support member 5 and which wedges into engagement with the top surface of the second support plate 6*a* of the second support 6**.

In theory, the seal body 7 may be retained in the closed position of the barge by two lateral ribs 8 and 9 or 8' and 9' which may be disposed on the lower plate or flange 5'. In any case, however, it is substantial to enlarge the seal body by applying an internal pressure thereto such that in the closed position of the barge, a sufficient contact pressure is exerted by the body upwardly and downwardly against the lower plate 5' as well as against the upper plate **6*a* of the second support 6**. At the same time, with the inventive arrangement, a uniform sealing over the entire length of the bottom joint is ensured even if the barge parts should bend slightly apart toward the center under the weight of the load.

Instead of a tubular seal body 7, another suitable seal body might be employed, for example, a solid rubber strip.

While specific embodiments of the invention have been shown and described in detail to illustrate the application of the principles of the invention, it will be understood that the invention may be embodied otherwise without departing from such principles. What is claimed is:

1. A hopper barge bottom seal construction, comprising a barge having first and second pivotal parts extending longitudinally and having lower ends extending obliquely downwardly toward each other, seal means provided at the lower ends of said parts sealing the space therebetween and comprising a first support having a first top horizontal member engaged below and secured to the bottom end of the first part, a second support having a second top horizontal member alongside said first top horizontal member in a closed position and being secured to said second barge part, said first support having a lower support plate extending below said second top horizontal member and the top of said lower support plate, an elastic cylindrical hollow tubular seal body filled with gas under pressure and disposed between the bottom of said second top horizontal member and the top or said lower support plate, a locking strip secured to said first top horizontal member and projecting outwardly therefrom into locking engagement over said second top horizontal member, and a substantially vertical rib on each side of said seal body extending substantially vertically downwardly from said second top horizontal member and holding the elastic seal body in position so that said seal body projects beyond said ribs toward the opposite lower support plate.

2. A hopper barge bottom seal construction, according to claim 1, wherein said ribs extend obliquely toward each other at their lower ends and are secured to the bottom of said second support.

* * * * *